US008917814B2

(12) United States Patent
Takai et al.

(10) Patent No.: US 8,917,814 B2
(45) Date of Patent: Dec. 23, 2014

(54) X-RAY GENERATOR AND COMPOSITE DEVICE USING THE SAME AND X-RAY GENERATING METHOD

(75) Inventors: Mikio Takai, Takarazuka (JP); Toshiyuki Ishida, Toyonaka (JP)

(73) Assignees: Mikio Takai, Takarazuka-shi, Hyogo (JP); BSR Co. Ltd., Nagoya-shi, Aichi (JP)

( * ) Notice: Subject to any disclaimer, the term of this patent is extended or adjusted under 35 U.S.C. 154(b) by 426 days.

(21) Appl. No.: 13/263,065

(22) PCT Filed: Apr. 5, 2010

(86) PCT No.: PCT/JP2010/002489
§ 371 (c)(1), (2), (4) Date: Oct. 5, 2011

(87) PCT Pub. No.: WO2010/116709
PCT Pub. Date: Oct. 14, 2010

(65) Prior Publication Data

US 2012/0027181 A1 Feb. 2, 2012

(30) Foreign Application Priority Data

Apr. 7, 2009 (JP) ..... 2009-092852

(51) Int. Cl.
*H01J 35/06* (2006.01)
*H05G 2/00* (2006.01)

(52) U.S. Cl.
CPC ..... *H01J 35/065* (2013.01); *H01J 35/06* (2013.01); *H05G 2/00* (2013.01); *H01J 2235/062* (2013.01)
USPC ..... 378/136; 378/122

(58) Field of Classification Search
CPC ... H01J 35/06; H01J 35/065; H01J 2235/062; H05G 2/00
USPC ..... 378/119, 122, 124, 134, 136, 121
See application file for complete search history.

(56) References Cited

U.S. PATENT DOCUMENTS 5,042,058 A * 8/1991 Rentzepis ..... 378/122
6,195,411 B1 * 2/2001 Dinsmore ..... 378/65

(Continued)

FOREIGN PATENT DOCUMENTS

JP 3090910 B 7/2000
JP 3090910 B1 7/2000

(Continued)

OTHER PUBLICATIONS

Michael Klopfer et al., "Characterization and optimization of pyroelectric x-ray sources using Monte Carlo spectral models," Nuclear Instruments and Methods in Physics Research A 689 (2012), pp. 47-51.*

(Continued)

*Primary Examiner* — Allen C. Ho
(74) *Attorney, Agent, or Firm* — Quarles & Brady LLP; Gavin J. Milczarek-Desai

(57) ABSTRACT

Disclosed is an X-ray generator (1) comprised of an electron emission element (10) which receives energy to emit electrons; a metal piece (20) which receives the electrons emitted from the electron emission element (10) to emit an X-ray; and energy supply portions (3, 5) which supply energy to the electron emission element (10), wherein the energy supply portions (3, 5) irradiate a pyroelectric element functioning as an electron emission element with, for example, ultraviolet pulsed light, and a high-energy local portion is formed in the pyroelectric element. Thus, the X-ray generator wherein the size thereof can be reduced, and an on/off control for the generation of X-ray can be easily performed, can be provided.

10 Claims, 2 Drawing Sheets

(56) References Cited

U.S. PATENT DOCUMENTS

| | | | | |
|---|---|---|---|---|
| 6,319,188 | B1 * | 11/2001 | Lovoi | 600/3 |
| 6,333,968 | B1 * | 12/2001 | Whitlock et al. | 378/136 |
| 6,882,703 | B2 * | 4/2005 | Price et al. | 378/91 |
| 7,027,560 | B2 * | 4/2006 | Kindlein | 378/141 |
| 7,085,350 | B2 * | 8/2006 | Dunham et al. | 378/119 |
| 7,136,455 | B2 * | 11/2006 | Dunham et al. | 378/119 |
| 7,187,755 | B2 * | 3/2007 | Dunham et al. | 378/119 |
| 7,266,178 | B2 * | 9/2007 | Grodzins | 378/122 |
| 7,412,033 | B2 * | 8/2008 | Freudenberger et al. | 378/136 |
| 7,496,179 | B2 * | 2/2009 | Freudenberger et al. | 378/122 |
| 7,508,917 | B2 * | 3/2009 | Dittrich et al. | 378/136 |
| 7,558,373 | B2 * | 7/2009 | Nakanishi et al. | 378/119 |
| 7,634,047 | B2 * | 12/2009 | Popescu et al. | 378/19 |
| 7,729,474 | B2 * | 6/2010 | Ito et al. | 378/119 |
| 7,738,632 | B2 * | 6/2010 | Popescu et al. | 378/136 |
| 7,741,615 | B2 * | 6/2010 | Putterman et al. | 250/424 |
| 7,791,019 | B2 * | 9/2010 | Beauchamp et al. | 250/288 |
| 7,796,733 | B2 * | 9/2010 | Hughes | 378/87 |
| 7,960,704 | B2 * | 6/2011 | Bromberg et al. | 250/424 |
| 8,130,897 | B2 * | 3/2012 | Popescu et al. | 378/4 |
| 8,223,925 | B2 * | 7/2012 | Shannon, Jr. | 378/147 |
| 8,755,493 | B2 * | 6/2014 | Travish et al. | 378/122 |

FOREIGN PATENT DOCUMENTS

| | | | |
|---|---|---|---|
| JP | 2006-120582 | A | 5/2006 |
| JP | 2009-009942 | A | 1/2009 |
| WO | 2008/123301 | A1 | 10/2008 |

OTHER PUBLICATIONS

T. Kisa et al., "Electron emission from LiNbO3 crystal excited by ultraviolet laser," Journal of Vacuum Science & Technology B 28(2), C2B27 (2010).*

M. Bayssie et al., "Generation of focused electron beam and x-rays by the doped LiNBO3 crystals," Nuclear Instruments and Methods in Physics Research B 241 (2005), pp. 913-916.*

Publication by AMP TEK, "Miniature X-ray Generator with Pyroelectric Crystal."*

James D. Brownridge and Sol Raboy, "Investigations of pyroelectric generation of x-rays," Journal of Applied Physics 86, pp. 640-647 (1999).*

Jeffrey Geuther et al., "Electron Acceleration for X-ray Production Using Paired Pyroelectric Crystals," AccApp'03: sixth International Meeting on Nuclear Applications of Accelerator Technology: accelerator applications in a nuclear renaissance, Jun. 1-5, 2003, San Diego, CA, p. 124.*

Ida, Hiroyuki et al., "Portable X-Ray Fluorescence Spectrometer with a Pyroelectric X-Ray Generator," X-Ray Spectrometry 2005: 34:225-229; published online Jan. 31, 2005 in Wiley InterScience (www.interscience.wiley.com). DOI: 10.1002/xrs.800.

Hiro, Eisuke et al., (Kyoto Univ.) "Develop of X-Ray Generator by Pyroelectric Crystal and Laser Light," 44th X-Ray Analysis Symposium, Oct. 18, 2008, P21.

* cited by examiner

X-RAY GENERATOR AND COMPOSITE DEVICE USING THE SAME AND X-RAY GENERATING METHOD

FIELD OF THE INVENTION

The present invention relates to an X-ray generator. More specifically, the present invention relates to an improved small X-ray generator.

BACKGROUND OF THE INVENTION

Development to reduce the size of an X-ray generator has been progressed because of requirement for space-saving, energy-saving, portability, minimization of exposure to an X-ray and the like.

For example, an X-ray generator having a small X-ray tube using a field emission carbon nanotube cathode and a high-frequency coaxial cable for applying high-voltage ultra-short pulses to the X-ray tube has been proposed (refer to Patent document 1).

Also an X-ray generator that irradiates a copper piece with electrons emitted from a pyroelectric element and that emits an X-ray from the copper piece has been proposed (Non-patent document 1).

Also Non-patent document 2 may be referred to as a technology related to the present invention.

PRIOR TECHNICAL LITERATURE

Patent Document

Patent document 1: Japanese Patent No. 3090910

Non-Patent Document

Non-patent document 1: Published online 31 Jan. 2005 in Wiley InterScience. DOI: 10. 1002/xrs. 800

Non-patent document 2: Development of an X-ray source using a pyroelectric crystal and a laser light, the forty-fourth X-ray analysis symposium, Oct. 18, 2008, P 21

DISCLOSURE OF THE INVENTION

Problems to be Solved by the Invention

All the above-described X-ray generators aim to fulfill the requirement for reducing the size. However, study performed by the inventors of the present invention revealed existence of following problems.

One of uses of the small X-ray generator is cancer treatment for inserting the small X-ray generator into a body and directly irradiating cancer cells with the X-ray. When a type using the field emission carbon nanotube cathode is studied from such the viewpoint, since such the type requires application of the high voltage to the cathode, people have feelings of resistance toward the use of such the type in a treatment site even if an insulating coaxial cable is used.

In a type using the pyroelectric element, the pyroelectric element is mounted on a Peltier element, and the pyroelectric element is heated by the Peltier element to emit the electrons from the pyroelectric element. Therefore, it is not required to use a high voltage as a voltage applied to the Peltier element. However, since the emission of the electrons continues from the pyroelectric element in the state of the increased temperature, on-off control of the X-ray generation is difficult. It is because it takes a time to cool the entire pyroelectric element to a state where the electron is not emitted.

Means for Solving the Problems

The present invention has been made to solve the above problems. A first aspect of the present invention is constructed as follows.

Namely, an X-ray generator comprising:

an electron emission element that receives energy to emit electrons;

a metal piece that receives the electrons emitted from the electron emission element to emit an X-ray; and an energy supply portion that supplies the energy to the electron emission element, wherein the energy supply portion forms a local high-energy part in the electron emission element.

In the X-ray generator according to the first aspect constructed in this way, the high-energy part formed in the electron emission element is localized. Such the local part is activated and serves as a cause of the electron beam emission. The energy state of the local high-energy part can be returned to a steady state in a short time. Accordingly, the on-off control of the X-ray generation can be performed easily.

A material having a pyroelectric characteristic such as a pyroelectric element can be used as the electron emission element. The pyroelectric element is called also as a hemimorphic crystal and has a following characteristic. That is, if temperature of the pyroelectric element is increased or decreased, spontaneous polarization inside the crystal increases or decreases, and surface-adsorbed charges become unable to follow the change. As a result, electric neutralization is broken and the charges (electrons) are emitted from the surface. A $LiNbO_3$ single crystal is a typical hemimorphic crystalline body. In the crystalline body, a centroid of a positive charge ($Li^+$, $Nb^{5+}$) does not coincide with a centroid of a negative charge ($O^{2-}$). Therefore, polarization occurs even in a steady state. Since charges having the same quantity and an opposite sign are adsorbed on the crystal surface, electrical neutralization is made normally.

In addition to the above-described $LiNbO_3$, one kind of $LiTaO_3$ and the like can be used singularly as the pyroelectric element or multiple kinds of them can be used as the pyroelectric element together.

As a result of study about the pyroelectric element performed by the inventors of the present invention, it was found that an electron beam is emitted from the pyroelectric element if the pyroelectric element as the electron emission element is irradiated with an ultraviolet light (second aspect).

According to the study by the inventors of the present invention, penetration depth of the ultraviolet light into the pyroelectric element is several tens of nanometers. Therefore, a portion that is activated by the ultraviolet light to have the high energy is only a part of a surface of the pyroelectric element, i.e., a local part.

It is preferable to set wavelength of the ultraviolet light to 300 nm or shorter (third aspect). It is because a most part of the ultraviolet light having such the short wavelength is absorbed by the pyroelectric element and therefore high energy conversion efficiency can be secured. More preferable wavelength of the ultraviolet light is 250 nm or shorter.

As mentioned above, the part of the pyroelectric element that receives the ultraviolet light to have the heightened energy is localized. Therefore, by making the ultraviolet light into a pulse shape and by applying the ultraviolet light to the pyroelectric element while controlling specifically an off-time of the pulse, spread of the high-energy part in the pyroelectric element can be prevented constantly. In other words, the localization of the part having the heightened energy in the pyroelectric element can be maintained (fourth aspect). Accordingly, such the part can be returned to the non-heightened energy state, i.e., a steady energy state, easily in a short time. Thus, the on-off control of the electron emission and eventually the on-off control of the X-ray emission can be performed easily.

A unit of a cycle of the pulse may be μsec or nsec.

It is preferable that a surface of the pyroelectric element on a side opposite from a side facing the metal piece is irradiated with the ultraviolet light.

Thus, the metal piece, the pyroelectric element and the energy supply portion (ultraviolet light generating portion) can be arranged linearly, so assembly of the devices can be facilitated.

When a rod-like pyroelectric element is used as the electron emission element, one end of the rod-like body is set to face the metal piece and the other end is irradiated with the ultraviolet light.

The electron emission can be promoted by microfabricating the surface (electron emission surface) of the pyroelectric element facing the metal piece and forming protrusions thereon.

The electron emission can be promoted by combining the pyroelectric element and carbon nanotubes.

A thin plate of copper or a copper alloy can be used as the metal piece. Other metal such as aluminum or an aluminum alloy than the copper can be used as long as the metal can emit the X-ray in response to the irradiated electrons.

In order to irradiate the pyroelectric element with the ultraviolet light, for example, a YAG laser oscillator is used as the ultraviolet light generating portion and the ultraviolet light generated by the ultraviolet light generating portion is introduced to one end of an optical fiber for ultraviolet light. The other end of the optical fiber is set to face the pyroelectric element. An ultraviolet light generating laser diode or a light-emitting diode made of a group-III nitride compound semiconductor may be used. When a higher output is necessary, an excimer laser oscillator should be preferably used.

MODES FOR IMPLEMENTING THE INVENTION

Figure 1:
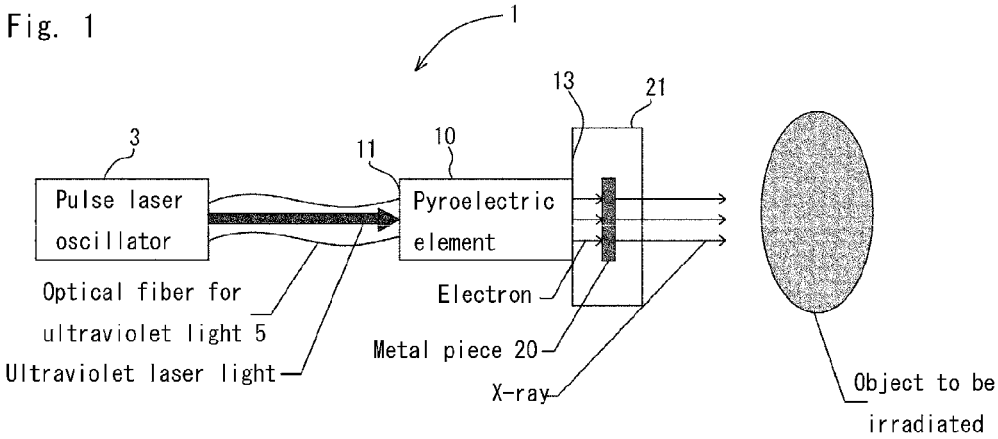
FIG. 1 is a conceptual diagram showing a construction of an X-ray generator according to the present invention.

Hereinafter, an embodiment of the present invention will be explained with respect to FIG. 1.

An X-ray generator 1 according to the embodiment has a pulse laser oscillator 3, an ultraviolet fiber 5 for ultraviolet light, a pyroelectric element 10 and a metal piece 20.

As an ultraviolet light generating portion, a Nd: YAG pulse laser oscillator 3 is employed. Rated specification of the pulse laser oscillator 3 is as follows. That is, wavelength is approximately 250 nm, pulse width is 100 μm, and the maximum output is approximately 350 mj.

A flexible quartz fiber can be used as the ultraviolet fiber 5.

A rod-like body of $LiNbO_3$ (diameter: 10 mm, length: 40 mm, both ends: flat surfaces) is used as the pyroelectric element 10. A surface (electron emission surface 13) of the pyroelectric element 10 facing the metal piece 20 is microfabricated by etching. Preferably, acicular protrusions are formed on the surface.

One end of the ultraviolet fiber 5 faces the pulse laser oscillator 3, and the other end of the ultraviolet fiber 5 faces a free end surface 11 of the pyroelectric element 10. Thus, the ultraviolet laser light outputted from the pulse laser oscillator 3 is introduced into the one end of the ultraviolet fiber 5 and is emitted from the other end of the ultraviolet fiber 5 to irradiate the pyroelectric element 10. It is preferable that the free end surface 11 of the pyroelectric element 10 opposite from the electron emission surface 13 facing the metal piece 20 is irradiated with the ultraviolet laser light. It is because arrangement of the elements becomes linear and assembly is facilitated.

It is preferable that the ultraviolet laser light is emitted to the free end surface 11 of the pyroelectric element 10 perpendicularly. It is because reflection can be inhibited and energy of the ultraviolet laser light can be supplied to the pyroelectric element 10 most efficiently.

A part of the free end surface 11 of the pyroelectric element 10 may be irradiated with the ultraviolet laser light. Alternatively, the entirety of the free end surface 11 may be irradiated with the ultraviolet laser light.

Figure 2:
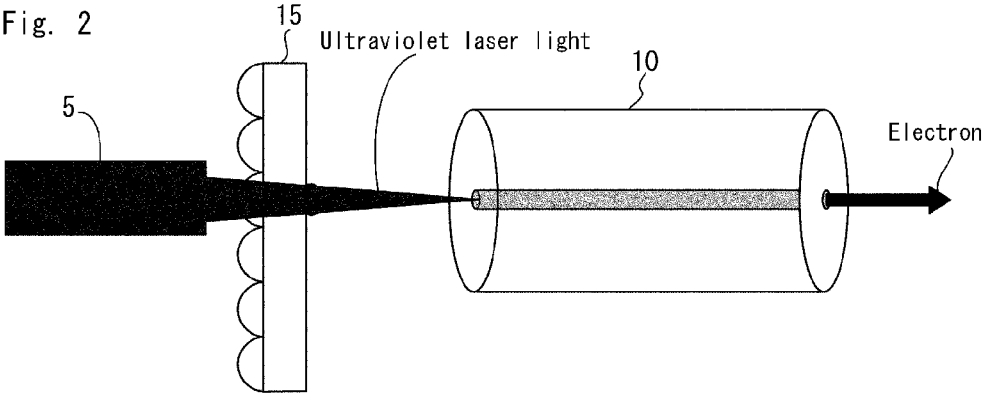
FIG. 2 shows a modified mode of the X-ray generator.

As shown in FIG. 2, a light condenser (Fresnel lens) 15 may be interposed between the ultraviolet fiber 5 and the pyroelectric element 10 to concentrate the ultraviolet laser emitted from the ultraviolet fiber 5.

Only a part of the free end surface 11 of the pyroelectric element 10 irradiated with the ultraviolet laser light is activated, and the electrons are emitted from a part of the electron emission surface 13 opposite to the irradiated part of the free end surface 11.

Quantity of the electrons emitted from the electron emission surface 13 per unit area (i.e., current density) corresponds to intensity of the ultraviolet laser light inputted to the free end surface 11. Therefore, the electrons are emitted to the metal piece 20 in a concentrated manner by concentrating the ultraviolet laser light as shown in FIG. 2. Thus, the intense X-ray can be emitted.

In this example, the ultraviolet laser light is emitted in the pulse shape. Therefore, the part of the pyroelectric element 10, in which the energy is heightened, does not spread in a radial direction of the pyroelectric element 10. In other words, the pulse width is regulated to prevent the spread of the high-energy part.

A copper piece is used as the metal piece 20. The copper piece 20 is arranged in a vacuum chamber 21, which is being vacuumed. The degree of vacuum is set arbitrarily according to a targeted output. A light inlet window (quartz window) is formed in the vacuum chamber 21. The electron beam emission surface 13 of the pyroelectric element 10 faces the light inlet window. An X-ray emission window is formed in a wall of the vacuum chamber 21 opposite from the side where the light inlet window is formed. The X-ray emission window is made of Be, for example.

Figure 3:
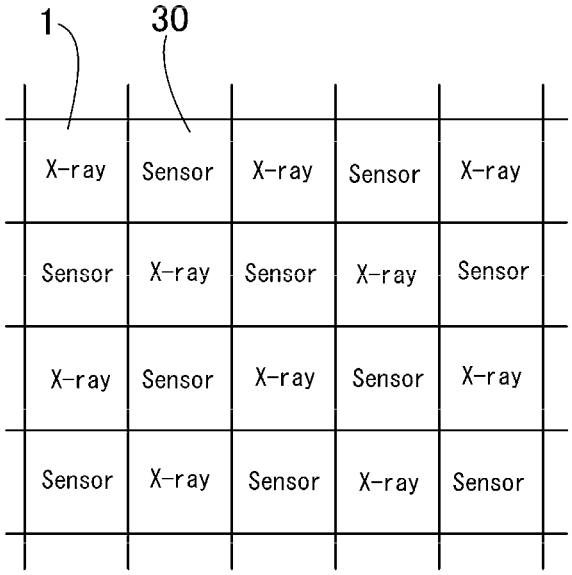
FIG. 3 shows a composite device provided by combining the X-ray generators and sensors.

Since the metal piece 20 directly serves as the X-ray source in the X-ray generator 1 constructed in this way, the X-ray source can be made small. In addition, since the metal piece 20, the pyroelectric element 10 and the ultraviolet fiber 5 are arranged linearly, the X-ray generators 1 can be arranged in a planar shape. Therefore, as shown in FIG. 3, the X-ray generators 1 can be arranged in the planar shape and sensors 30 can be arranged among the X-ray generators 1. An optical sensor or a pH sensor can be used as the sensor 30.

By inserting the composite device shown in FIG. 3 into a body cavity, characteristics of a diseased part can be observed with the sensors 30 while irradiating the diseased part with the X-ray. For example, by marking cancer cells with an X-ray fluorescent material beforehand, existence of the cancer cells can be determined with the optical sensors 30 while irradiating the cancer cells with the X-ray.

If the light source (pulse laser oscillator 3) of the X-ray generator 1 is replaced with a visible light or an infrared light, the X-ray generators shown in FIG. 3 can be used as a general light source. In this case, length of the pyroelectric element 10 or thickness of the metal piece 20 is adjusted such that the light of the light source can pass through the pyroelectric element 10 and the vacuum chamber 21.

In the above example, the high-energy part of the pyroelectric element is localized by irradiating the pyroelectric element with the ultraviolet pulsed light. Thus, the state can be returned quickly from the high-energy state to the steady state. Thus, the on-off control of the electron beam irradiation, i.e., the X-ray generation, can be performed easily. Other methods may be employed as long as the high-energy part of the pyroelectric element can be localized. For example, by bringing an exothermic body such as the Peltier element into contact with the pyroelectric element discontinuously, the temperature increase of the entirety of the pyroelectric element can be prevented, and the high-energy part of the pyroelectric element can be localized.

A ferroelectric body capable of emitting electrons by receiving an ultraviolet light may be used as the electron emission element.

The present invention is not limited to the above explanation of the embodiments or examples. Various modifications within the scope easily devised by those skilled in the art without departing from the description of the scope of claims are also included in the present invention.

DESCRIPTION OF THE REFERENCE NUMERALS

1 X-ray generator
3 Pulse laser oscillator
5 Fiber for ultraviolet light
10 Pyroelectric element
20 Metal piece

What is claimed is:

1. An X-ray generator comprising:
an electron emission element that receives energy to emit electrons;
a metal piece that receives the electrons emitted from the electron emission element to emit an X-ray; and
an energy supply portion that supplies the energy to the electron emission element, wherein
the energy supply portion irradiates the electron emission element with an ultraviolet light.

2. The X-ray generator as in claim 1, wherein the ultraviolet light has wavelength of 300 nm or shorter.

3. The X-ray generator as in claim 1, wherein the electron emission element is irradiated with the ultraviolet light in a pulse shape.

4. The X-ray generator as in claim 1, wherein a surface of the electron emission element on a side opposite from a side facing the metal piece is irradiated with the ultraviolet light.

5. The X-ray generator as in claim 1, wherein
the energy supply portion has an ultraviolet light generating portion that generates the ultraviolet light and a fiber for ultraviolet light, and
the energy supply portion irradiates the electron emission element with the ultraviolet light, which is generated by the ultraviolet light generating portion, via the fiber for ultraviolet light.

6. A composite device comprising:
the X-ray generator as in claim 1; and
a sensor capable of measuring a physical quantity or a chemical quantity, wherein
the X-ray generator and the sensor are arranged on the same plane.

7. A generating method of an X-ray using an X-ray generator having:
an electron emission element that receives energy to emit electrons;
a metal piece that receives the electrons emitted from the electron emission element to emit an X-ray; and
an energy supply portion that supplies the energy to the electron emission element, the generating method comprising:
supplying the energy from the energy supply portion to the electron emission element by irradiating the electron emission element with ultraviolet light.

8. The X-ray generating method as in claim 7, wherein the ultraviolet light has wavelength of 300 nm or shorter.

9. The X-ray generating method as in claim 7, wherein irradiating the electron emission element with the ultraviolet light occurs in a pulse shape.

10. The X-ray generating method as in claim 7, wherein irradiating the electron emission element comprises irradiating a surface of the electron emission element on a side opposite from a side facing the metal piece-with the ultraviolet light.

* * * * *